US007562509B2

(12) United States Patent
Ness

(10) Patent No.: US 7,562,509 B2
(45) Date of Patent: Jul. 21, 2009

(54) EXTERIOR BUILDING PANEL WITH CONDENSATION DRAINING SYSTEM

(75) Inventor: George Ness, Santa Ana, CA (US)

(73) Assignee: The Carvist Corporation, Placentia, CA (US)

( * ) Notice: Subject to any disclaimer, the term of this patent is extended or adjusted under 35 U.S.C. 154(b) by 0 days.

(21) Appl. No.: 11/609,219

(22) Filed: Dec. 11, 2006

(65) Prior Publication Data

US 2008/0134594 A1 Jun. 12, 2008

(51) Int. Cl.
*E04C 2/38* (2006.01)
*E04F 13/076* (2006.01)
*E04F 13/24* (2006.01)

(52) U.S. Cl. ..... 52/800.11; 52/302.3; 52/235; 52/512

(58) Field of Classification Search ..... 52/510–512, 52/508, 235, 302.3, 302.4, 302.1, 800.1, 52/800.11
See application file for complete search history.

(56) References Cited

U.S. PATENT DOCUMENTS

| | | | | | |
|---|---|---|---|---|---|
| 4,050,201 | A | | 9/1977 | Hubbard et al. | |
| 4,070,806 | A | | 1/1978 | Hubbard | |
| 4,483,122 | A | | 11/1984 | Crandell | |
| 4,543,755 | A | | 10/1985 | Crandell | |
| 4,611,447 | A | | 9/1986 | Krechel | |
| 4,644,717 | A | | 2/1987 | Biebuyck | |
| 4,685,263 | A | | 8/1987 | Ting | |
| 4,691,487 | A | * | 9/1987 | Kessler | 52/209 |
| 4,732,633 | A | * | 3/1988 | Pokorny | 156/94 |
| 4,924,647 | A | * | 5/1990 | Drucker | 52/235 |
| 5,007,765 | A | * | 4/1991 | Dietlein et al. | 404/74 |
| 5,212,914 | A | * | 5/1993 | Martin et al. | 52/235 |
| 5,218,798 | A | * | 6/1993 | Bentivegna et al. | 52/206 |
| 5,260,345 | A | * | 11/1993 | DesMarais et al. | 521/148 |
| 5,289,664 | A | * | 3/1994 | Rizza et al. | 52/302.1 |
| 5,425,672 | A | * | 6/1995 | Rotter | 454/365 |
| 5,452,552 | A | | 9/1995 | Ting | |
| 5,501,044 | A | * | 3/1996 | Janesky | 52/169.5 |
| 5,596,851 | A | | 1/1997 | Ting | |
| 5,598,671 | A | | 2/1997 | Ting | |
| 6,158,182 | A | | 12/2000 | Biebuyck | |
| 6,195,948 | B1 | * | 3/2001 | Lamanna | 52/200 |
| 6,405,508 | B1 | * | 6/2002 | Janesky | 52/741.4 |
| 6,619,004 | B2 | * | 9/2003 | Loper | 52/302.1 |
| 6,745,527 | B1 | | 6/2004 | Sherman et al. | |
| 6,823,633 | B2 | * | 11/2004 | Ryan | 52/302.1 |
| 7,183,230 | B2 | * | 2/2007 | Elkouh et al. | 442/121 |
| 2002/0029535 | A1 | * | 3/2002 | Loper | 52/302.1 |
| 2002/0121052 | A1 | * | 9/2002 | Olink | 52/102 |

(Continued)

*Primary Examiner*—Gay Ann Spahn
(74) *Attorney, Agent, or Firm*—Jerry Turner Sewell

(57) ABSTRACT

A building panel subject to interior condensation of moisture and exterior wind-driven moisture includes a sheet having an inner surface onto which condensed moisture forms. An open upper reservoir is positioned proximate a bottom portion of the inner surface of the sheet to receive the condensed moisture. A lower chamber having at least one drain port is positioned below the upper reservoir. A wicking port connects the upper reservoir to the lower chamber. The wicking port weeps the condensed moisture from the upper reservoir to the lower chamber to drain the upper reservoir. The condensed moisture drains from the lower chamber via the drain port. The wicking port blocks the upward flow of wind-driven moisture that enters the lower chamber via the drain port.

13 Claims, 9 Drawing Sheets

U.S. PATENT DOCUMENTS

2003/0046888 A1* 3/2003 Ryan ..... 52/302.1
2004/0067352 A1* 4/2004 Hagerman et al. ..... 428/304.4
2006/0032171 A1* 2/2006 Weir et al. ..... 52/404.1
2006/0118769 A1* 6/2006 Zam et al. ..... 254/1
2007/0022686 A1* 2/2007 Smith ..... 52/302.1
2007/0044402 A1* 3/2007 Hess ..... 52/302.1
2007/0094965 A1* 5/2007 Mitchell ..... 52/302.1

* cited by examiner

EXTERIOR BUILDING PANEL WITH CONDENSATION DRAINING SYSTEM

BACKGROUND OF THE INVENTION

1. Field of the Invention

The present invention is in the field of exterior panels for building construction.

2. Description of the Related Art

Exterior building panels are subjected to temperature and pressure differentials caused by varying weather conditions. For example, on cold days, the exterior surface of a building panel may be subjected to lower temperatures, which causes the interior surface of the building panel to have a temperature lower than the interior temperature of the building onto which the panel is mounted. Accordingly, moisture within the building condenses on the interior surface of the panel. The condensed moisture must be removed from the inner surface of the panel in order to stop the moisture from accumulating with the building and causing moisture-related problems.

Various systems have been used to try to eliminate the condensed moisture. For example, one system includes a gutter or other reservoir along the lowermost portion of the interior surface of the building panel to receive the condensed moisture. The gutter has a drain opening to allow the condensed moisture to drain to the outside of the building. The gutter has sidewalls with a height selected to provide a volume in the gutter sufficient to store an expected maximum quantity of condensed water as well as to store exterior moisture that is blown into the gutter via the drain opening. Because the pressure caused by strong winds can be quite high, it is possible for such wind-driven moisture to increase within the gutter to a level sufficient to overflow the walls of the gutter. Other systems include flaps over the drain opening that close when high winds or a large pressure differential may force exterior moisture into the gutter via the drain opening. Such flaps are subject to failure and also may prevent the drainage of the condensed moisture during sustained high wind conditions. Other systems include a second chamber below the gutter. The second chamber is open at each end to allow the condensed moisture from the gutter to flow outward at each side of the panel.

SUMMARY OF THE INVENTION

Known systems do not provide consistent results under all conditions. Accordingly, a new system and method were developed to provide an elegant and economical solution for draining condensed moisture and infiltrate from the interior surface of a building panel while blocking the entry of wind-driven exterior moisture.

An aspect in accordance with the present invention is a building panel that is subject to interior condensation of moisture and exterior wind-driven moisture. The building panel includes a sheet having an inner surface onto which condensed moisture forms. An open upper reservoir proximate a bottom portion of the inner surface of the sheet receives the condensed moisture. A lower chamber having at least one drain port is positioned below the upper reservoir. A wicking port connects the upper reservoir to the lower chamber. The wicking port transports the condensed moisture from the upper reservoir to the lower chamber to drain the upper reservoir. The condensed moisture drains from the lower chamber via the drain port. The wicking port blocks the upward flow of wind-driven moisture that enters the lower chamber via the drain port.

Preferably, the wicking port comprises an opening between the upper reservoir and the lower chamber. The opening is substantially plugged with a wicking material, such as, for example, open-cell foam backer rod. The wicking material causes pressure to increase in the lower chamber as a volume of wind-driven moisture increases in the lower chamber. The increase in pressure offsets the external pressure caused by the wind to inhibit further increases in the volume of the wind-driven moisture in the lower chamber.

In an embodiment, the sheet comprises metal. In another embodiment, the sheet comprises glass, stone or other suitable material. In one preferred embodiment, the sheet comprises a laminate of at least one metal layer and a non-metallic layer. The sheet may also comprise other materials, such as, for example, composite materials.

The sheet is advantageously installed on a vertical side of a building as a curtain wall or other cladding. The sheet may also be installed at an angle with respect to vertical. For example, the sheet may comprise glass and comprise at least part of a skylight.

In certain preferred embodiments, the upper reservoir and the lower chamber are formed as a single extrusion.

Another aspect in accordance with embodiments of the present invention is an exterior building panel that comprises a sheet having an exterior surface and an interior surface. A frame supports the sheet and connects the sheet to a building structure. A condensation drain system is positioned on the interior surface of the sheet. The drain system comprises an upper reservoir positioned proximate a lower portion of the interior surface of the sheet. The upper reservoir has an upper opening to receive condensation that forms on the interior surface. The upper reservoir has side walls and a bottom wall to hold the condensation therein. At least one reservoir wicking port is formed in the bottom wall of the reservoir. The reservoir wicking port comprises an opening in the bottom wall of the reservoir plugged with a wicking material. A lower chamber is positioned below the upper reservoir. The lower chamber has a top wall formed by the bottom wall of the upper reservoir. The lower chamber has side walls and a bottom wall to hold condensation received from the upper reservoir via the reservoir wicking port. The bottom wall of the lower chamber has at least one drain port to drain condensation from the lower chamber. The lower chamber permits condensation received from the upper reservoir to drain to the exterior via the drain port. The wicking material in the wicking port blocks the upward flow of exterior moisture forced into the lower chamber by pressure differentials and wind.

Another aspect in accordance with embodiments of the present invention is a method for draining condensed moisture from an interior surface of a building panel. The method comprises receiving the condensed moisture in an upper reservoir of a drainage system positioned proximate a bottom portion of the interior surface of the building panel. The method further comprises wicking the condensed moisture from the upper reservoir to a lower chamber through a wicking material in a wicking port. The method further comprises draining the lower chamber via a drain port communicating with an exterior location. The method uses the wicking material in the wicking port to block the flow of moisture from the lower chamber upward into the upper reservoir.

Further aspects of the present invention shall become apparent from the ensuing description and as illustrated in the accompanying drawings.

BRIEF DESCRIPTIONS OF THE DRAWINGS

Exemplary embodiments in accordance with the present invention are described below in connection with the accompanying drawing figures in which.

DETAILED DESCRIPTIONS OF PREFERRED EMBODIMENTS

Figure 1:
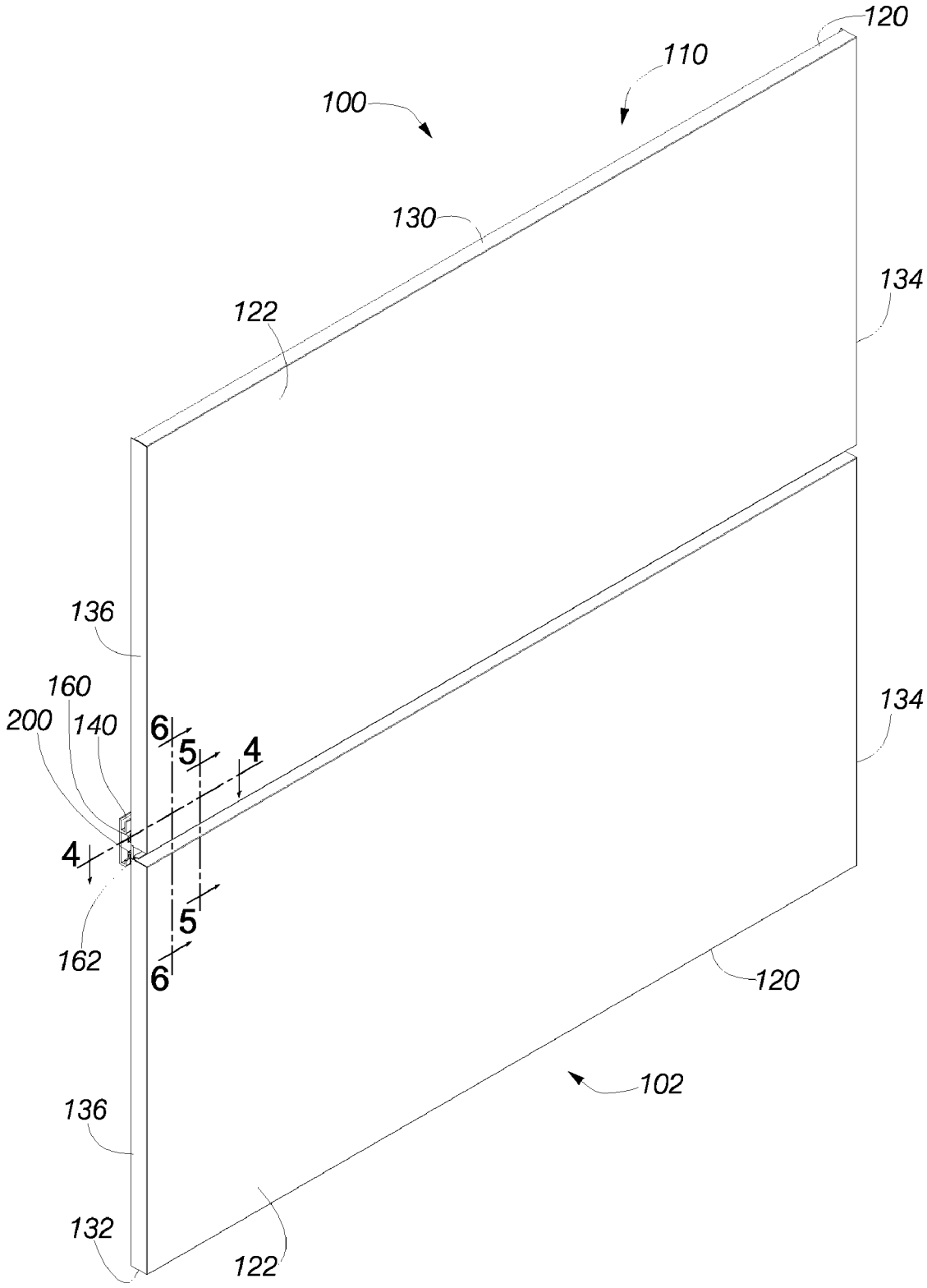
FIG. 1 illustrates a perspective view of two building panels looking from the outside of the panels.

The following description and the accompanying drawings illustrate exemplary embodiments of an exterior building panel in accordance with the present invention. The description and drawings are intended to be illustrative of the inventions defined in the appended claims. In the drawings, like numerals refer to like parts throughout.

Figure 2:
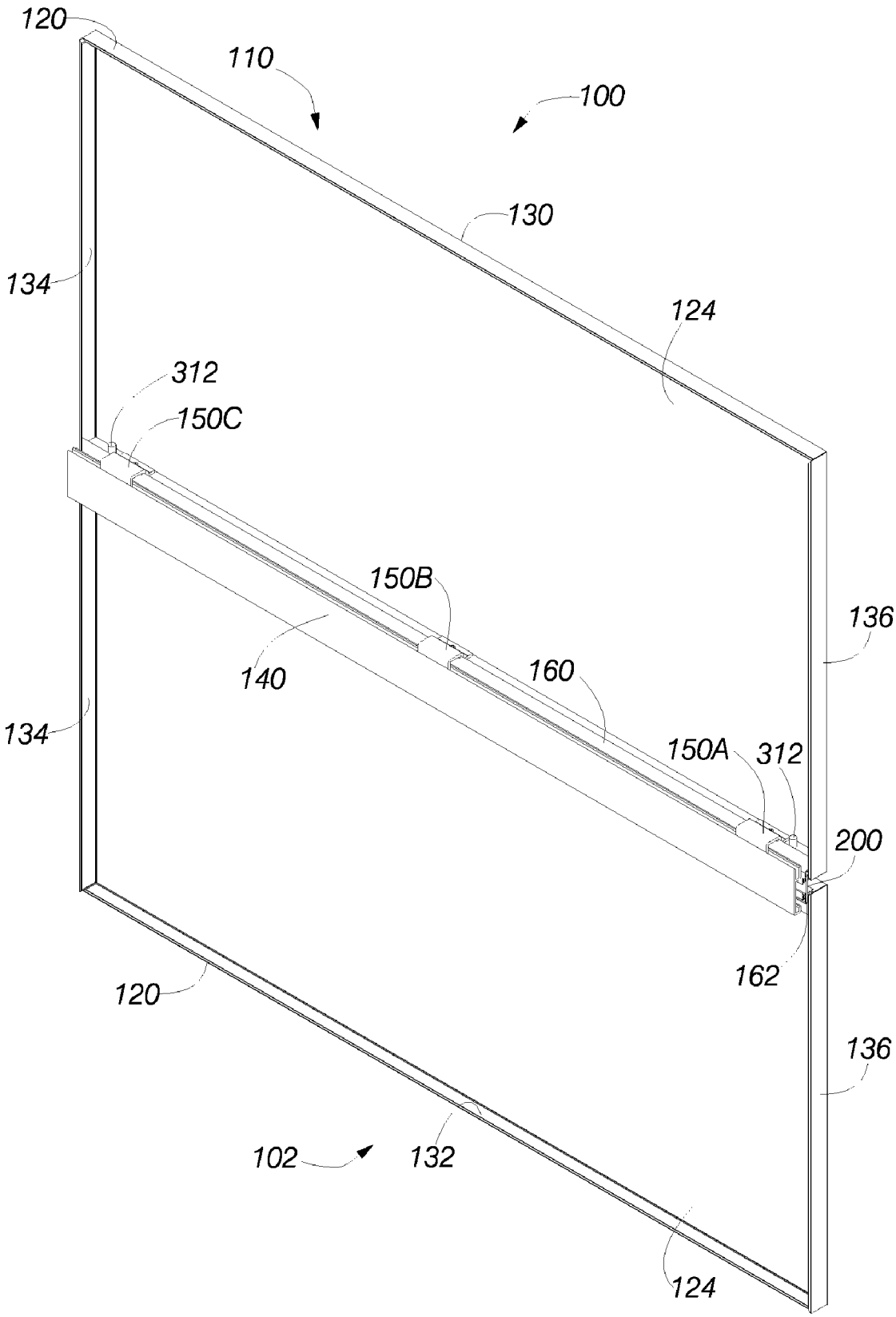
FIG. 2 illustrates a perspective view of the two building panels in FIG. 1 looking from inside of the panels.
Figure 3:
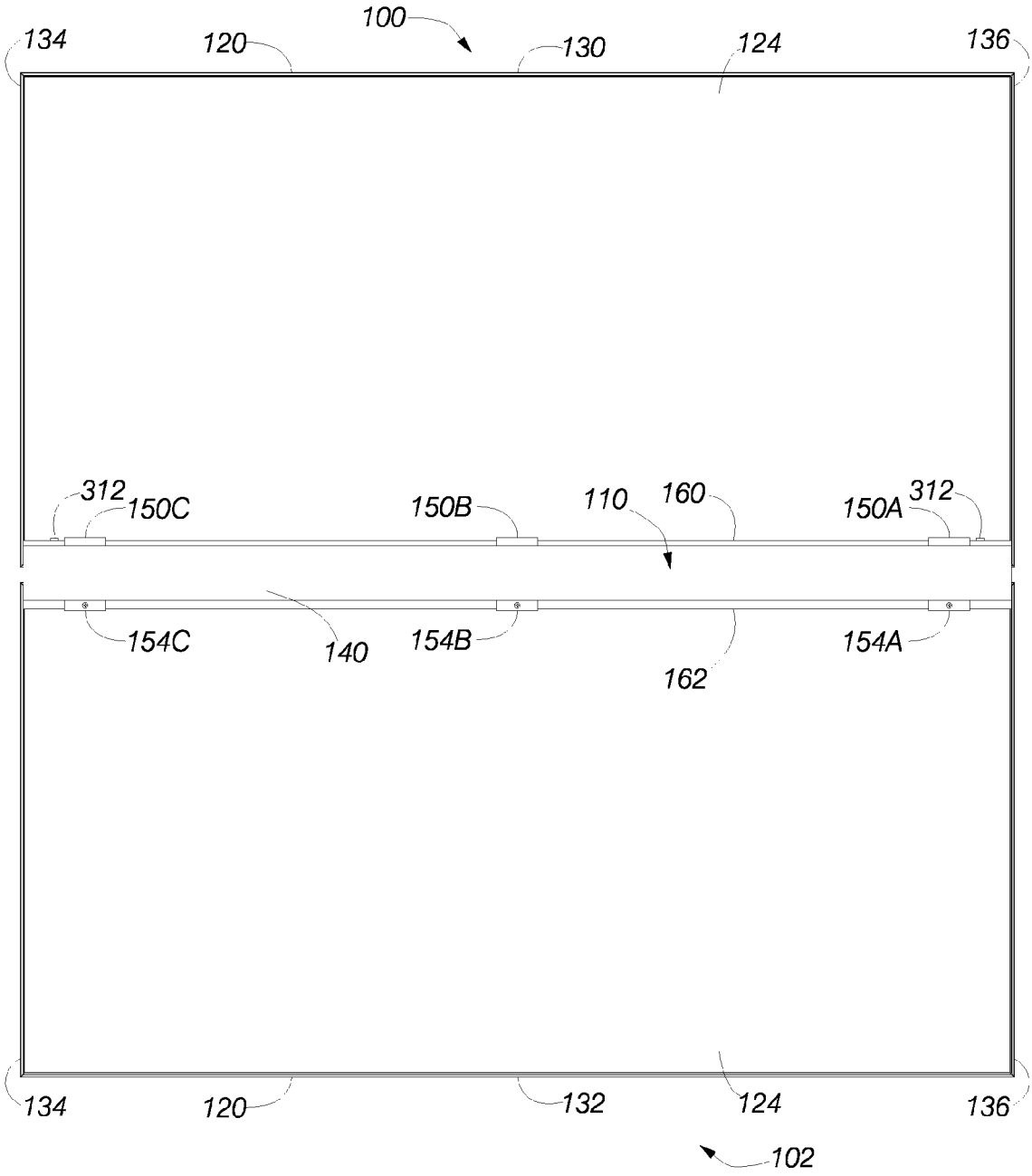
FIG. 3 illustrates a rear elevational view that shows the building bracket and the upper and lower mounting brackets in exemplary positions with respect to the panels.

FIG. 1 illustrates a perspective view of a portion of an exterior wall of a building (not shown) showing the outsides of a first exterior wall panel 100 and a second exterior wall panel 102, wherein the second wall panel 102 is positioned below the first wall panel 100. A building advantageously includes additional panels vertically above the two panels and horizontally on either or both sides of the two panels. FIG. 2 illustrates a perspective view of the two wall panels 100, 102 looking from the interior of the building. FIG. 3 illustrates a rear elevational view of the interiors of the two wall panels 100, 102.

As illustrated in FIGS. 1-3, the two panels 100, 102 are mounted on a mounting structure 110. In particular, the bottom of the upper (first) wall panel 100 is supported by the mounting structure 110, and the top of the lower (second) wall panel is supported by the mounting structure 110. Similar mounting structures (not shown) provide additional support for the top of the upper panel 100 and for the bottom of the lower panel 102. In certain preferred embodiments, additional mounting structures (not shown) are positioned vertically alongside the building panels to seal the spaces between adjacent panels. The vertical mounting structures are advantageously constructed in the manner described below for the horizontal mounting structures.

In the illustrated embodiment, the panels are substantially identical in construction, and the following description directed to the upper panel 100 also applies to the lower panel 102.

The upper panel 100 comprises a generally planar laminated sheet 120 having a metallic outer layer 122 that is exposed to the outside environment and having a metallic inner layer 124 that faces the building on which the panels are mounted. Accordingly, the outer layer 122 is exposed to rain, wind, high and low temperatures, and the like, while the inner layer 124 is exposed to inside conditions of the building. It should be understood that the building may include insulation and interior wall materials (not shown); however, in general the inner surface 124 is exposed to the temperature and humidity prevalent in the building.

In the illustrated embodiment, the inner layer 122 and the outer layer 124 of the laminated sheet 120 comprise a thin layer (e.g., 1/32 inch) of aluminum or other suitable metal. The sheet 120 further includes an intermediate layer 126 of a non-metallic material, such as, for example, a plastic material. The intermediate layer enables the sheet 120 to be constructed with a selected thickness without having to construct the sheet 120 out of a single thickness of multiple thicknesses of metal. Thus, the sheet 120 can be manufactured with substantially less weight than an all-metal panel while provide an outward appearance and environmental characteristics of a metal panel. It should be understood that the upper panel 100 and the lower panel 102 may also comprise other materials, such as, for example, glass, stone, composite materials or the like. The system described herein is fully compatible with such construction materials, and the dimensions described below are readily adjustable to accommodate the thicknesses of such materials.

The upper panel further comprises an upper side wall 130, a lower side wall 132, a right side wall 134 and a left side wall 136 are generally perpendicular to the outer surface 122. When installed on a building, the four side walls are sealed against the building in a manner described below to provide a weather-tight covering over the portion of the building covered by the panel 100.

As shown in FIGS. 2 and 3, the mounting structure 110 includes a building bracket 140, which is attached to the structure of a building using suitable fasteners (e.g., screws, bolts, adhesives, or the like). The building bracket 140 is installed with shims (not shown) if required to provide a substantially horizontal and substantially straight mounting surface onto which the other mounting hardware (described below) are mounted. Although shown as having the same length as the width of the panel 100, it should be understood that the building bracket 140 can have different lengths in accordance with design criteria. For example, the building bracket 140 may advantageously comprise strips with longer lengths to support multiple horizontally adjacent panels. The building bracket 140 may also comprise a plurality of shorter segments that are positioned only where needed to support the other mounting hardware.

Figure 4:
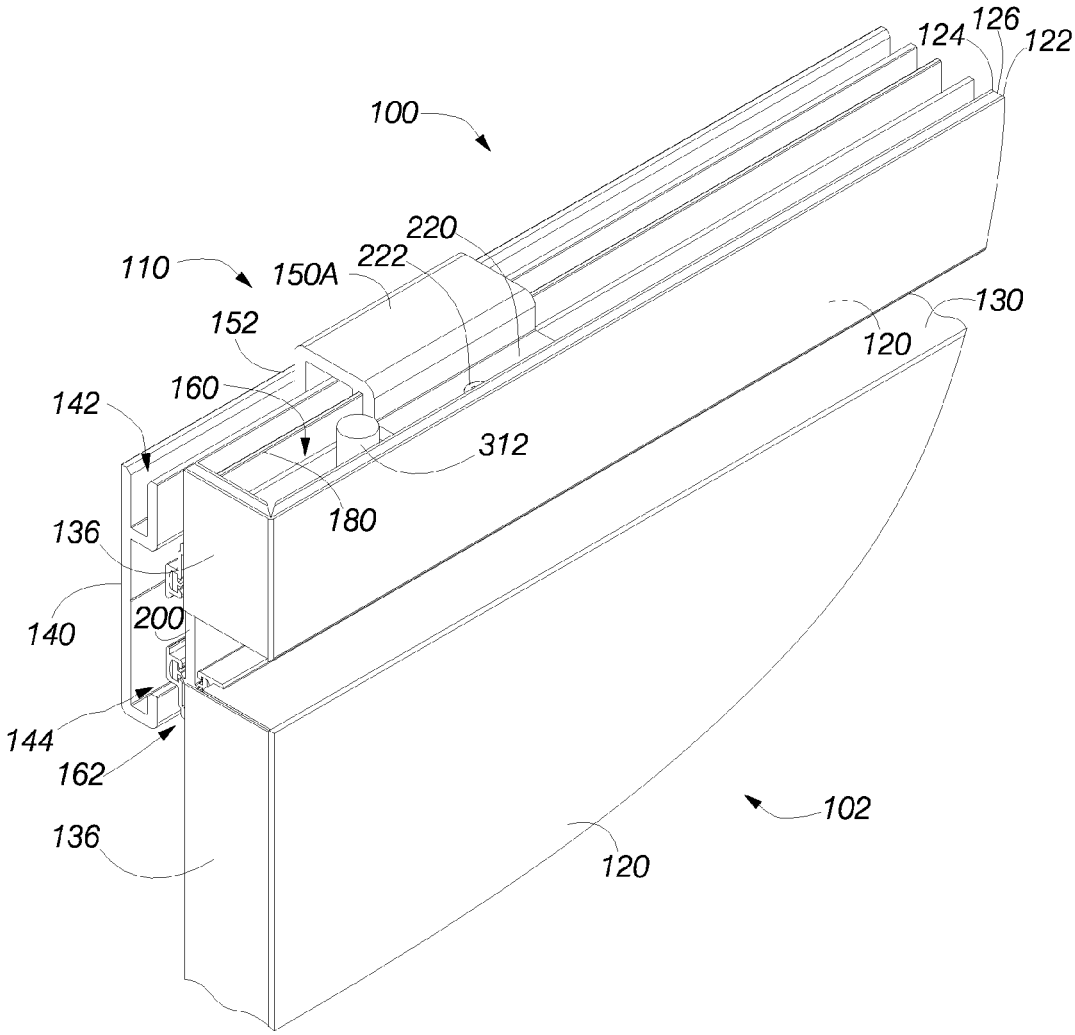
FIG. 4 illustrates a partial cross-sectional perspective view taken along the section line 4-4 in FIG. 1 showing the upper chamber and showing the position of the wick in the upper chamber.
Figure 5:
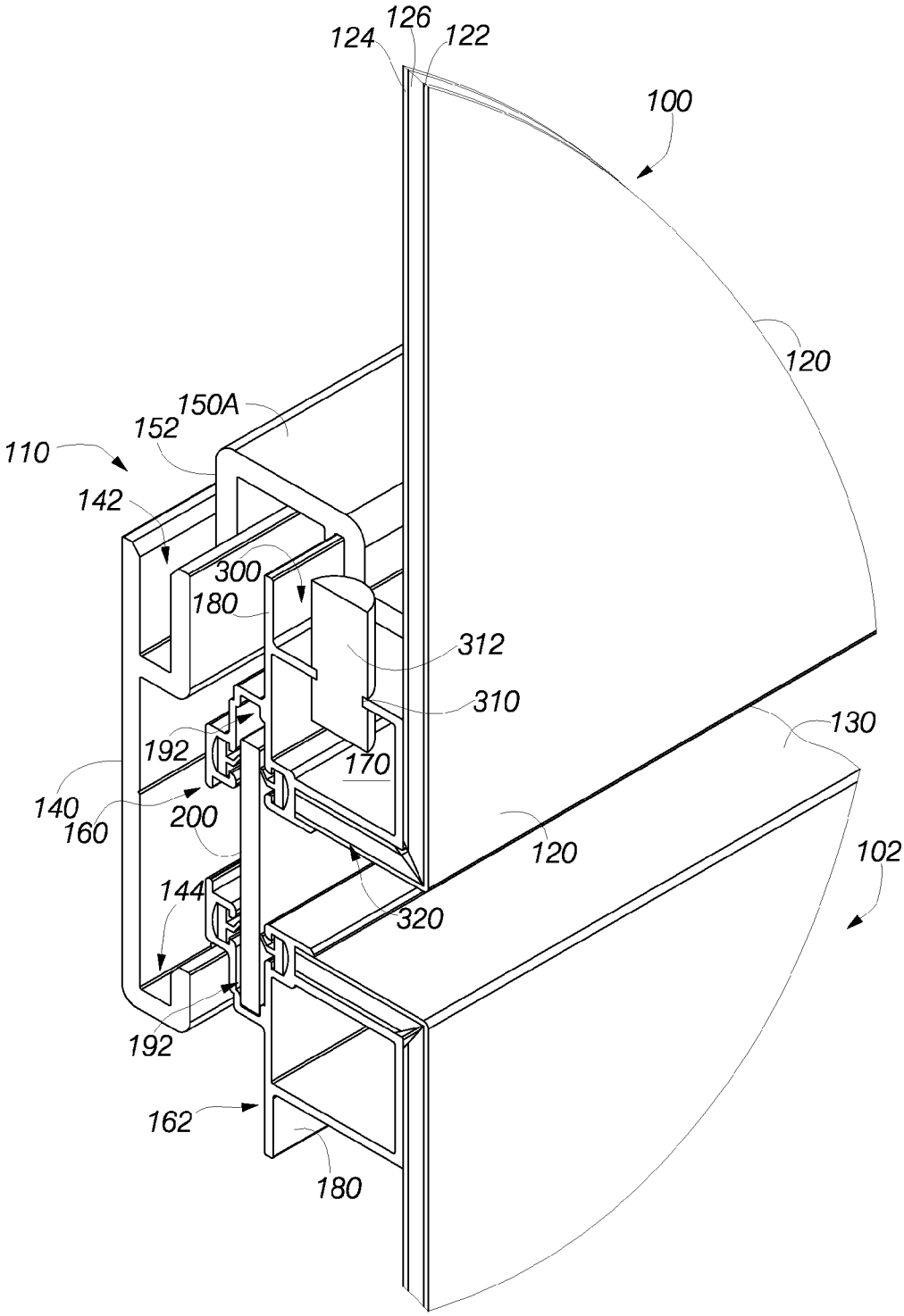
FIG. 5 illustrates a partial cross-sectional perspective view taken along the section line 5-5 in FIG. 1 showing the wick passing through the floor of the upper channel into the lower chamber.
Figure 6:
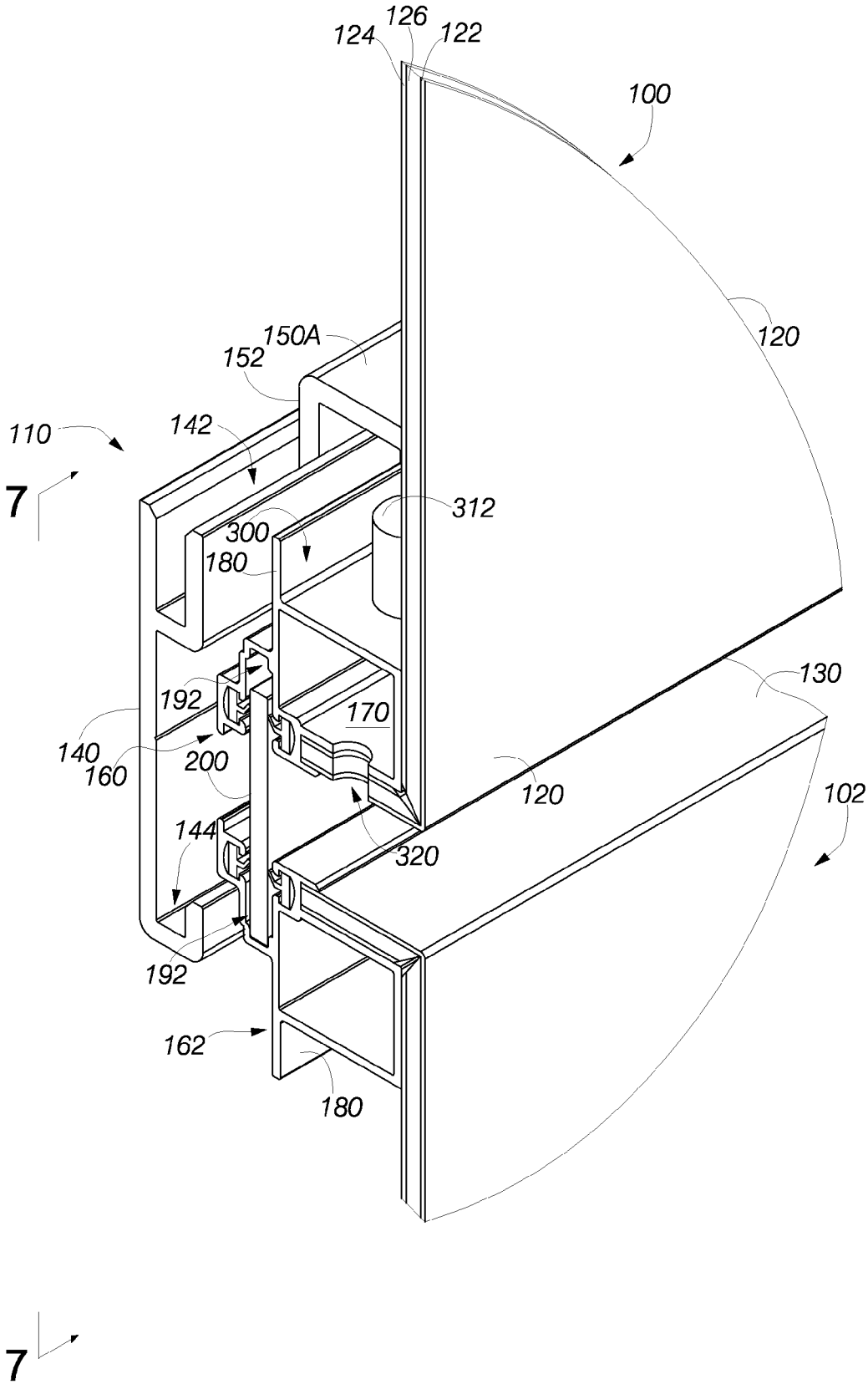
FIG. 6 illustrates a partial cross-sectional perspective view taken along the section line 6-6 in FIG. 1 showing the weep hole through the floor of the lower chamber.
Figure 7:
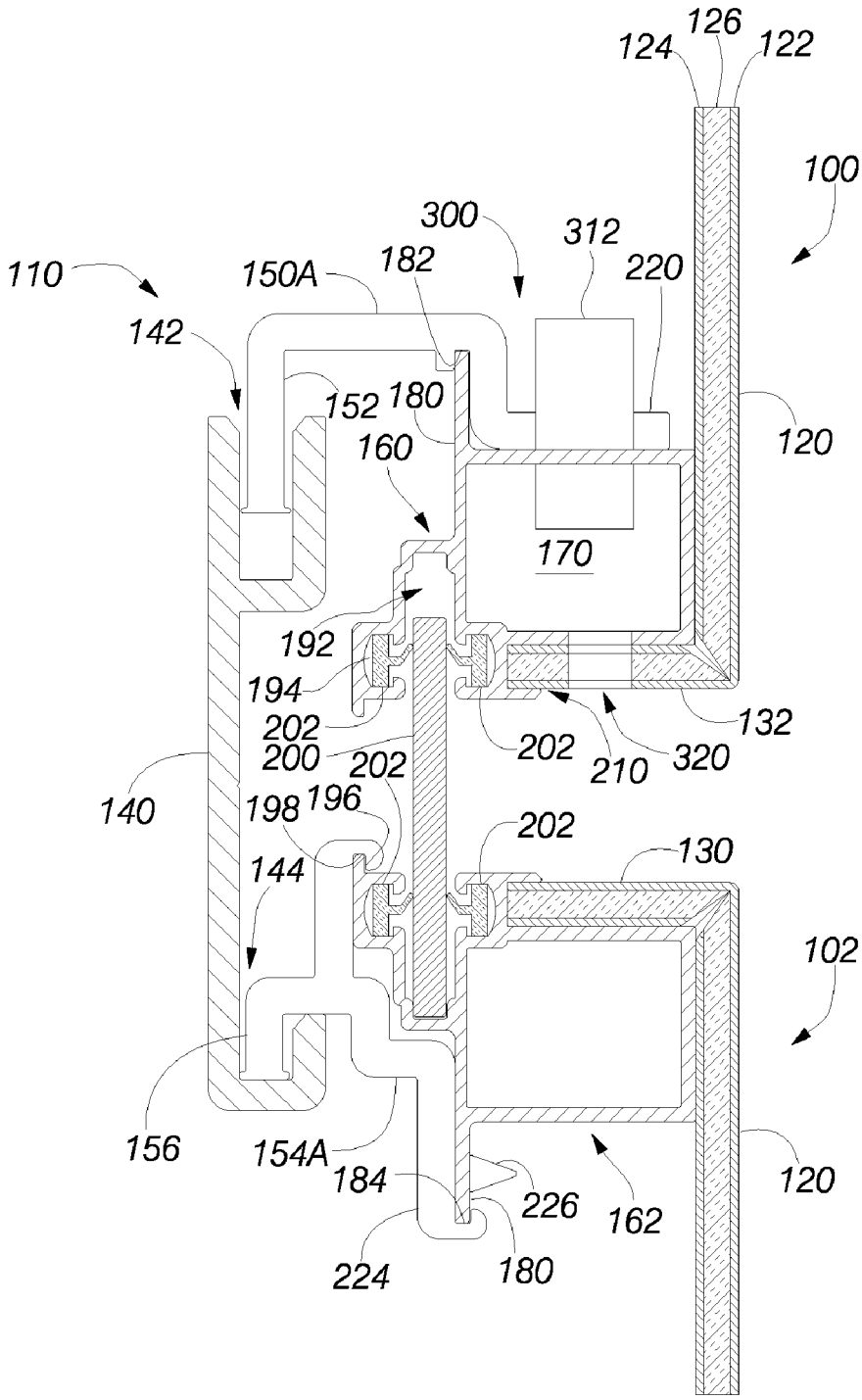
FIG. 7 illustrates a partial cross-sectional elevational view taken along the line 7-7 in FIG. 6 to show the profile of the extrusion forming the upper channel and the lower chamber and further showing the inside wall of the panel forming one wall of the upper channel.

As shown more clearly in the sectional perspective views in FIGS. 4, 5 and 6 and the cross-sectional view in FIG. 7, the building bracket 140 includes an upper slot 142 and a lower slot 144. Both slots are generally U-shaped. In the illustrated embodiment, the upper slot 142 has a greater depth than the lower slot 144.

The mounting structure 110 further includes a plurality of upper mounting brackets 150A, 150B, 150C, which include respective mounting legs 152 that are inserted in the upper slot 142 of the building bracket 140. The mounting structure further includes a plurality of lower mounting brackets 154A, 154B, 154C, which include respective mounting legs 156 that are inserted in the lower slot 144 of the building bracket 140. Although illustrated herein as including three upper brackets and three lower brackets, the mounting structure may include more or fewer of the mounting brackets in accordance with the weight of the panels and the expected weather conditions (e.g., the wind conditions). Furthermore, as described below, the weight of the each panel is supported primarily by the lower building brackets. Accordingly, the mounting structure may advantageously include fewer upper mounting brackets than lower mounting brackets.

The upper mounting brackets 150A, 150B, 150C support an upper extrusion 160. The lower mounting brackets 154A, 154B, 154C support a lower extrusion 162. In the following description, the "upper" extrusion and "lower" extrusion are referenced to the mounting structure 110 as shown in the illustrations. It should be readily understood that the upper extrusion 160 is at the bottom of a respective building panel and the lower extrusion is at the top of a respective building panel.

As illustrated in FIG. 7, the upper extrusion 160 and the lower extrusion 162 are substantially identical except that the lower extrusion 162 is mounted with an orientation that is the vertical mirror of the orientation of the upper extrusion 160. Accordingly, only a single type of extrusion is needed to provide the two mounting functions. Preferably, the two extrusions 160, 162 are formed by extruding aluminum. By using the same extrusion profile for the upper extrusion 160 and the lower extrusion 162, only a single extrusion die is needed to produce both extrusions. Although described herein as comprising single extrusions, it should be understand that the upper extrusion 160 and the lower extrusion 162 may each be formed by interconnecting multiple extrusions. The lower extrusion 162 may have a profile that differs from the profile of the upper extrusion 160. One or both of the two extrusions may be formed of a material other than aluminum.

Figure 8:
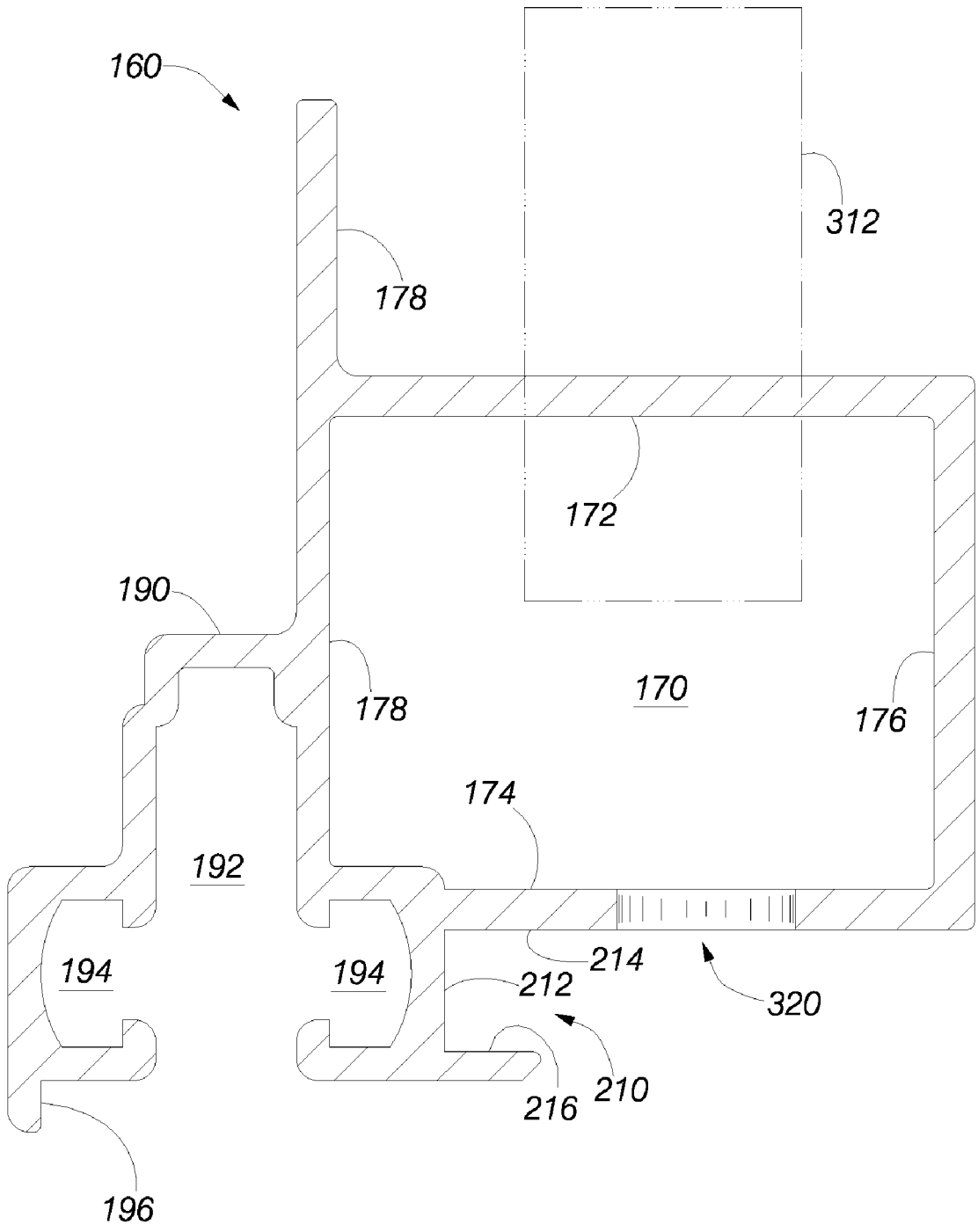
FIG. 8 is an enlarged cross-sectional end view of the extrusion prior to installation on a panel to show the features in more detail.

As shown in FIGS. 4-7, each extrusion 160, 162 includes a chamber portion 170. As shown in more detail in FIG. 8 for the upper extrusion 160, the chamber portion 170 is enclosed by an upper wall 172 (as viewed in the orientation of the upper extrusion 160), a lower wall 174 (again, as viewed in the orientation of the upper extrusion 160), an outer wall 176 and an inner wall 178. The features of the upper extrusion 160 are numbered in FIG. 8. Although not explicitly numbered in the figures, the features of the lower extrusion 162 are identical and are numbered accordingly. In the illustrated embodiment, the cavity is formed by an opening between the walls having a vertical height of approximately 0.64 inch and a horizontal width of approximately 0.82 inch. The upper wall 172, the lower wall 174 and the outer wall 176 each have a thickness of approximately 0.055 inch. The inner wall 178 has a thickness of approximately 0.045 inch. Each dimension can be adjusted to adapt the profile of the extrusion 160 to a desired size and shape.

Each extrusion 160, 162 further includes a flange portion 180, which is perpendicular to the upper wall 172 and is generally aligned with the inner wall 178. The flange portion 180 of the upper extrusion 160 extends upward from the chamber 170, and the flange portion 180 of the lower extrusion 162 extends downward from the chamber 170. As illustrated in FIG. 7, the flange portion 180 of the upper extrusion 160 fits into a slot 182 formed in the upper mounting bracket 152A. Similarly, the flange portion 180 of the lower extrusion 162 fits into a first slot 184 of the lower mounting bracket 154A.

Each extrusion 160, 162 further includes an inwardly extending protuberance 190, which includes a cavity 192. The cavity 192 is generally T-shaped with the stem of the T shape in a vertical orientation. The cavity 192 of the upper extrusion 160 is open downwardly, and the cavity 192 of the lower extrusion 162 is open upwardly. The horizontal portions of each T-shaped cavity 190 form opposing side chambers 194.

The protuberance 190 further includes a short flange portion 196 that extends vertically from the side of the protuberance disposed away from the chamber 170. The short flange portion 196 extends in the opposite direction from the flange portion 180. Accordingly, the short flange portion 196 of the upper extrusion 160 extends downwardly from the protuberance 190, and the short flange portion 196 of the lower extrusion 162 extends vertically upward from the protuberance 190. As shown in FIG. 7, the short flange portion 196 of the lower extrusion 162 engages a second slot 198 of the lower mounting bracket 154A. The short flange portion 196 of the upper extrusion 160 is not used in the illustrated embodiment.

The cavities 192 receive a spline 200, which extends vertically between the two extrusions 160, 162 as shown in FIG. 7. The spline 200 is generally planar and extends horizontally to fill in the gap between the upper panel 100 and the lower panel 102. The spline 200 has a lower end which rests in the cavity 192 of the lower extrusion 162 and has an upper end which extends into the cavity 192 of the upper extrusion 160. In the illustrated embodiment, the panels are spaced apart by approximately ¾ inch and the gasket 200 has a length of approximately 1.5 inches. In the illustrated embodiment, the gasket 200 has a thickness of approximately ⅛ inch. The spline 200 advantageously comprises aluminum or other suitable material. The spline 200 has a selectable length. For example, multiple sections of the spline 200 can be positioned end-to-end across the width of a building wall with the gaps between adjacent gaskets sealed in a suitable manner to provide a weather-tight joint.

Each side chamber 194 receives a respective gasket 202 that is inserted into the side chamber from an end. Each gasket 202 has a body portion having a vertical dimension selected to fit snuggly between an upper wall and a lower wall of the side chamber 194. Each gasket 202 has bent extended portion that extends into the central portion of the respective cavity 192. The bent portions of the gasket 202 contact the side walls of the spline 200 when the spline 200 is inserted in the cavities 192. The gaskets 202 comprise an elastomeric material that forms watertight seals against the side walls of the spline 200. The lengths of the gaskets 202 are selectable. For example, the lengths may generally correspond to the horizontal widths of the panels. Two gaskets 202 may be placed end-to-end and the joint sealed with suitable adhesive if required.

Each extrusion 160, 162 further includes a panel edge receptacle 210 that is positioned on the side of chamber 170 opposite the flange portion 180. Accordingly, the panel edge receptacle 210 of the upper extrusion 160 is positioned below the chamber 170, and the panel edge receptacle 210 of the upper extrusion 160 is positioned above the chamber 170. Each panel edge receptacle 210 has a vertical end 212 that is formed by a wall of the protuberance 190. Each panel edge receptacle 210 includes a first horizontal side 214 that is formed by the lower wall 174 of the chamber 170. A second horizontal side 216 of the panel edge receptacle 210 is parallel to the first horizontal side 214 and is spaced apart from the first horizontal side 214 by a distance selected to match the thicknesses of the lower side wall 132 of the upper panel 100 and the upper side wall 130 of the lower panel 102. Thus, as illustrated in FIG. 7, the lower side wall 132 of the upper panel 100 fits snugly in the panel edge receptacle 210 of the upper extrusion 160, and the upper side wall 130 of the lower panel 112 fits snugly in the panel edge receptacle 210 of the lower extrusion 162. For example, in one embodiment, the sides 212, 214 of the panel edge receptacle are spaced apart by 0.166 inch.

Each upper mounting bracket 150A, 150B, 150C includes a horizontal leg 220, which is attached to the upper wall 172 of the upper extrusion by a suitable fastening device, such as, for example, a screw 222 (FIG. 4). Each lower mounting bracket 154A, 154B, 154C includes a vertical leg 224, which is attached to the inner wall 178 of the lower extrusion 162 by a suitable fastening device, such as, for example, a screw 226. As illustrated for the lower mounting bracket 154A in FIG. 7, for example, the weight of the lower building panel 102 is supported vertically by the engagement of the flange portion 180 with the first slot 184 of each of the lower mounting brackets 154A, 154B, 154C. The lower building panel 102 is prevented from moving outwardly by the engagement of the short flange portion 196 with the second slot 198 of each of the lower mounting brackets 154A, 154B, 154C. Accordingly, the screws 222, 224 are not required to support the weight of a building panel are to keep the building panel from moving outwardly from the mounting system 110. Although not required, the screws 222, 224 are advantageously used for maintaining the horizontal positions of the extrusions 160, 162 with respect to the mounting brackets. Thus, the screws 222, 224 can be relatively small.

As further shown in FIG. 7, horizontal position of the upper extrusion 160 perpendicular to the building mounting bracket 140 is fixed by the engagement of the leg 152 of the upper mounting bracket 150A in the slot 142 of the building mounting bracket 140; however, the leg 152 is free to move vertically within a range determined by the depth of the slot 142. The ability to move vertically allows the upper extrusion 160 to move in response to expansion and contraction of the upper building panel 100, which is supported at its upper end by a lower mounting bracket (not shown) of another mounting structure.

As shown in FIG. 7, the upper side wall 130 and the lower side wall 132 of the panels 100, 110 have lengths selected so that when the lower side wall 132 of the upper panel 100 is engaged in the panel edge receptacle 210, the inner surface 124 of the panel 120 is positioned against the outer wall 176 of the chamber 170 of each extrusion 160, 162. Accordingly, with respect to the upper extrusion 160, the inner surface 124 of the upper panel 100 forms a side wall of an upper channel 300. The flange 180 forms a second side wall of the upper channel 300, and the upper wall 172 of the chamber 170 forms the floor of the upper channel 300. The right side wall 134 and the left side wall 136 form the ends of the upper channel 300. In the illustrated embodiment, the left and right side walls 134, 136 are advantageously longer than the upper and lower side walls 130, 132 to conform to the profile of the upper and lower extrusions 160, 162. The intersections of the inner surface 124 and the left and right side walls 134, 136 with the upper extrusion 160 are sealed with silicon adhesive, or the like, to form a watertight channel. The chamber 170 is similarly sealed at each end by the left side wall 134 and the right side wall 136 to produce an airtight and watertight lower chamber except for the specific openings into and out of the lower chamber 170 described below.

In an alternative embodiment, a substantially similar mounting structure 110 is secured to the underlying building vertically, and the side walls of each panel 100, 102 are secured to similar extrusions 160, 162. In such an embodiment, the ends of the lower chamber are not sealed by the side walls. Accordingly, in the alternative embodiment, the ends of the upper extrusion 160 are sealed to produce the airtight and watertight chamber.

Gravity causes moisture that condenses in the inner surface 124 and on the inside surfaces of the side walls 134, 136 to drop into the upper channel 300. The upper channel 300 also receives any infiltrate that may enter the panel through a leak in a seam or the like. Although a simple opening in the floor of the upper channel 300 would allow the accumulated moisture to drain, the opening would also allow wind-driven moisture to enter the channel 300 from below and to possibly overflow the wall of the channel formed by the flange 180. As shown in FIG. 5, the upper chamber 300 includes a hole 310; however, the hole 310 is plugged with a wick 312, which advantageously comprises a porous material, such as, for example, commercially available open-cell foam backer rod. The wick 312 may advantageously comprise other suitable materials, such as, for example, a short segment of woven polypropylene rope. As illustrated, the wick 312 is generally cylindrical and has a diameter selected to be larger than the diameter of the hole 310 so that when the wick 312 is forced into the hole 310, the wick 312 is securely retained in the hole 310. For example, the hole 310 may advantageously have a diameter of 5/16 inch, and the wick 312 may advantageously have a diameter of 3/8 inch or larger.

Although one wick 312 is sufficient to drain the upper channel 300, in the illustrated embodiment, an optional second wick 314 is included at the opposite end of the channel 300 in order to avoid the accumulation of residual moisture in case the channel 300 is not completely level when the panel 100 is installed on a building.

The wick 312 and the optional second wick 314 allow accumulated condensed moisture and infiltrate to slowly wick through the hole 310 and to drip into the lower chamber 170. Although slow, the wicking action is sufficiently fast to empty accumulated condensed moisture and infiltrate from minor leaks.

The moisture that wicks into the lower chamber 170 is drained through at least one weep hole 320 formed through the lower wall 174 of the lower chamber 170 and through the lower side wall 132 of the panel 100. An additional weep hole (not shown) may be included at the opposite end of the lower chamber 170.

The weep hole 320 may allow wind-driven rain and other moisture to enter the lower chamber 170. Unlike prior systems, however, the wind-driven rain cannot pass from the lower chamber 170 to the upper channel 300 and possibly overflow the wall of the upper channel 300 formed by flange 180. Rather, as the quantity of water driven into the lower chamber 170 increases, the wick 312 blocks the flow of water through the hole 310 into the upper channel 300. Although the porous wick 312 allows water to seep through by wicking action, the wick 312 blocks any rapid flow of water and air through the hole 310. Accordingly, as wind-driven water builds up in the lower chamber 170, the weight of the water and the pressure of trapped air in the lower chamber 170 causes the lower chamber to reach a state of equilibrium where no further wind-driven water can enter the lower chamber through the weep hole 320. When the wind subsides, the wind-driven water will drain through the weep hole 320.

Figure 9:
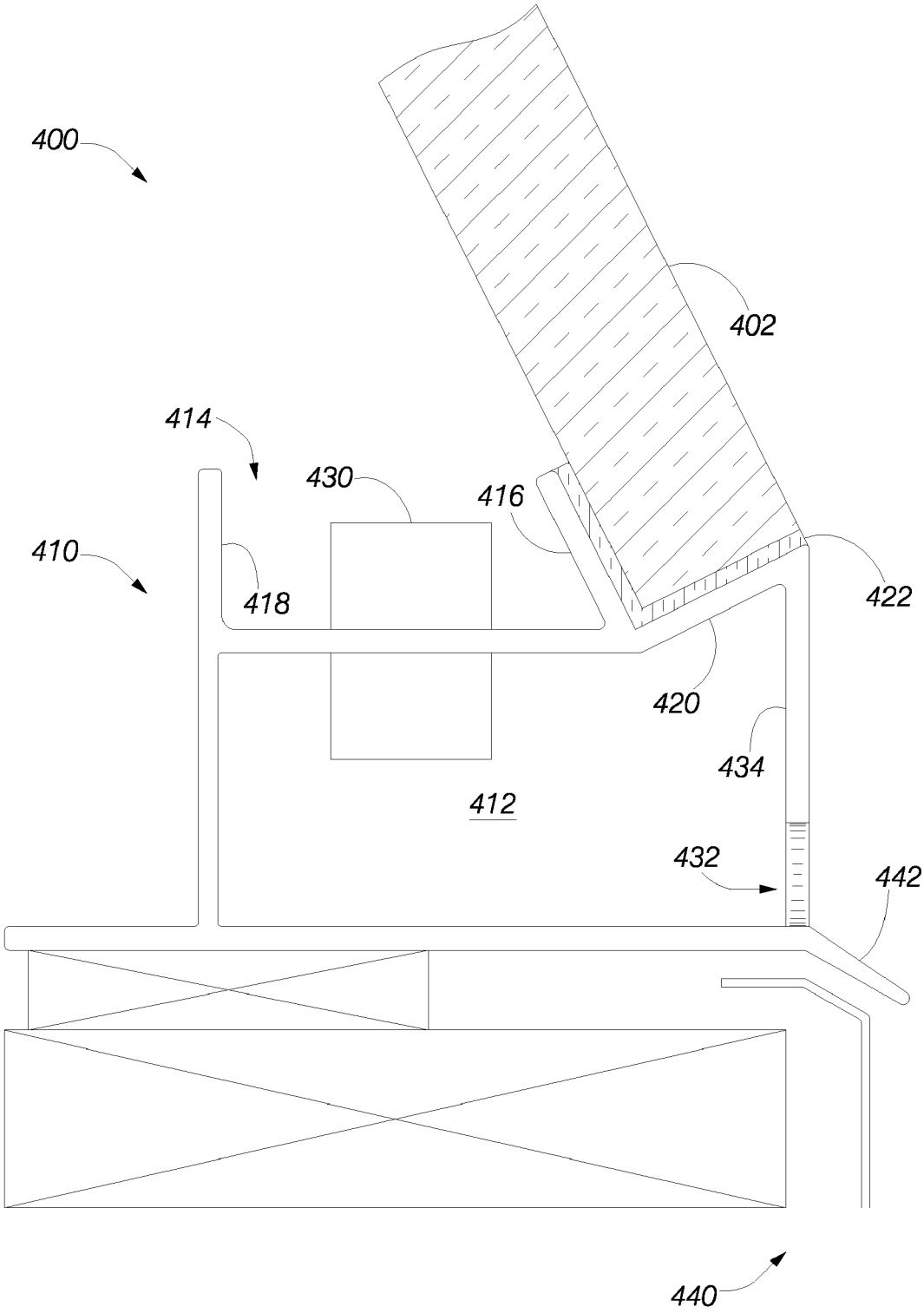
FIG. 9 illustrates an embodiment for use with slanted panels, such as, for example, glass panels in a skylight.

As shown in FIG. 9, the panel mounting system with the wicking water drainage improvement is adaptable to sloping panels, such as, for example, a sloping glass panel 402 in a skylight 400. An extrusion 410 includes a lower chamber 412 and an upper channel 414. The upper channel 414 is formed by a first flange 416, a second flange 418 and channel ends (not shown). As illustrated, the first flange 416 and a slanted portion 420 of the top of the lower chamber 412 are positioned at an angle to receive a lower end of the sloped glass panel 402. The glass panel 402 is sealed to the first flange 416 and the slanted portion 420 a layer of suitable weather-resistant adhesive 422, such as, for example, a silicon adhesive.

Moisture that accumulates on the inside of the glass panel 400 drops into the upper channel 414 and is slowly wicked through a wick 430 into the lower chamber 412, which is sealed except for a weep hole 432. In the illustrated embodiment, the weep hole 432 is formed at near the bottom of a side 434 of the lower chamber 412. The water emitted from the weep hole is directed away from the side of the structure 440 underlying the skylight 400 by a lip 442.

The wick 430 functions as described above to block wind-driven water from flowing into the upper channel 414 from the lower chamber 412. In particular, any wind-driven water that enters the lower chamber 412 via the weep hole 432 may increase in volume within the lower chamber 412 until the level of the water is above the upper edge of the weep hole 432. Thereafter, as the water level increases the trapped air and the weight of the water in the lower chamber 412 will eventually provide sufficient pressure to block entry of additional water into the lower chamber 412.

It should be understood that the profiles of the extrusions 160, 162 shown in FIGS. 1-8 and the extrusion 410 shown in FIG. 9 are exemplary extrusions only for the illustrated embodiments. The extrusions can be readily modified to have profiles adapted for other panel configurations, such as, for example, panels having thicker walls or longer side walls.

The present invention is disclosed herein in terms of a preferred embodiment thereof, which provides an exterior building panel as defined in the appended claims. Various changes, modifications, and alterations in the teachings of the present invention may be contemplated by those skilled in the art without departing from the intended spirit and scope of the appended claims. It is intended that the present invention encompass such changes and modifications.

I claim:

1. A building panel subject to interior condensation of moisture and exterior wind-driven moisture, comprising:

a sheet having an inner surface onto which condensed moisture forms;

an open upper reservoir positioned proximate a bottom portion of the inner surface of the sheet to receive the condensed moisture, the upper reservoir having a floor;

a lower chamber positioned immediately below the upper reservoir, the lower chamber and the upper reservoir separated by the floor of the upper reservoir, the floor of the upper reservoir bounding the lower chamber, the lower chamber having at least one drain port;

a wicking port comprising an opening in the floor of the upper reservoir; and wicking material that substantially blocks the wicking port, the wicking material extending into the upper chamber and wicking the condensed moisture from the upper reservoir to the lower chamber to drain the upper reservoir, the condensed moisture draining from the lower chamber via the at least one drain port, the wicking material in the wicking port blocking the upward flow of wind-driven moisture that enters the lower chamber via the drain port.

2. The building panel as defined in claim 1, wherein the wicking material comprises an open-cell foam backer rod.

3. The building panel as defined in claim 1, wherein the wicking material causes pressure to increase in the lower chamber as a volume of wind-driven moisture increases in the lower chamber, the increase in pressure offsetting the external pressure caused by the wind to inhibit further increases in the volume of the wind-driven moisture in the lower chamber.

4. The building panel as defined in claim 1, wherein the sheet comprises metal.

5. The building panel as defined in claim 1, wherein the sheet comprises glass.

6. The building panel as defined in claim 1, wherein the sheet comprises stone.

7. The building panel as defined in claim 1, wherein the sheet comprises a laminate of at least one metal layer and a non-metallic layer.

8. The building panel as defined in claim 1, wherein the sheet comprises a composite material.

9. The building panel as defined in claim 1, wherein the sheet is installed at an angle with respect to vertical.

10. The building panel as defined in claim 9, wherein the building panel comprises at least part of a skylight.

11. The building panel as defined in claim 1, wherein the upper reservoir and the lower chamber are formed as a single extrusion.

12. An exterior building panel, comprising:

a sheet having an exterior surface and an interior surface;

an extrusion coupled to the interior surface of the sheet to form a condensation drain system, the extrusion having a shape that forms a lower chamber and an upper reservoir, the lower chamber and the upper reservoir separated by a common wall that forms an upper boundary of the lower chamber and a lower boundary of the upper reservoir, the common wall having at least one opening formed therein between the upper reservoir and the lower chamber, the upper reservoir having an upper opening to receive moisture that forms on the interior surface of the sheet, the lower chamber having side walls and a bottom wall, the bottom wall having at least one drain port; and wicking material positioned in the opening in the common wall to plug the opening in the common wall, the wicking material permitting moisture in the upper reservoir to wick downward from the upper reservoir into the lower reservoir, the wicking material blocking exterior moisture entering the lower chamber via the at least one drain port from flowing upward through the opening in the common wall and entering the upper reservoir.

13. The exterior building panel as defined in claim 12, wherein the extrusion includes features for engaging a mounting structure.

* * * * *